US007950535B1

(12) United States Patent
Schmid

(10) Patent No.: US 7,950,535 B1
(45) Date of Patent: May 31, 2011

(54) SKATEBOARD DECK DISPLAY SYSTEM

(76) Inventor: Mark S. Schmid, San Diego, CA (US)

( * ) Notice: Subject to any disclaimer, the term of this patent is extended or adjusted under 35 U.S.C. 154(b) by 568 days.

(21) Appl. No.: 12/051,877

(22) Filed: Mar. 20, 2008

(51) Int. Cl.
*A47F 7/00* (2006.01)

(52) U.S. Cl. ..... 211/85.7

(58) Field of Classification Search ..... 211/85.7, 211/94.01, 70.6, 86.01, 183, 41.16; 248/224.41
See application file for complete search history.

(56) References Cited

U.S. PATENT DOCUMENTS

| | | | | |
|---|---|---|---|---|
| 2,683,890 | A * | 7/1954 | Rosenbaum | 16/87.4 R |
| 2,683,891 | A * | 7/1954 | Rosenbaum | 16/87.4 R |
| 3,713,616 | A * | 1/1973 | Bowers | 410/105 |
| 4,270,681 | A * | 6/1981 | Ingram | 224/321 |
| 4,588,117 | A * | 5/1986 | Bott | 224/321 |
| 4,747,025 | A * | 5/1988 | Barton | 362/147 |
| 4,911,348 | A * | 3/1990 | Rasor et al. | 224/321 |
| 5,120,012 | A | 6/1992 | Rosenau | |
| 5,201,487 | A * | 4/1993 | Epplett | 248/298.1 |
| D342,637 | S | 12/1993 | Smith | |
| 5,301,818 | A | 4/1994 | Dix | |
| 6,050,426 | A * | 4/2000 | Leurdijk | 211/94.01 |
| 6,196,397 | B1 | 3/2001 | Maher | |
| 6,293,412 | B1 | 9/2001 | Draper | |
| 6,311,854 | B1 * | 11/2001 | Anderson | 211/70.6 |
| 6,467,745 | B1 | 10/2002 | Sickels | |
| 6,591,996 | B1 * | 7/2003 | Wu | 211/90.02 |
| 6,631,813 | B1 * | 10/2003 | Walter et al. | 211/94.01 |
| 6,712,226 | B1 | 3/2004 | Williams, Jr. | |
| D499,594 | S | 12/2004 | Laitila | |
| 6,854,607 | B2 * | 2/2005 | Tong | 211/70.6 |
| 6,938,864 | B2 | 9/2005 | Simonian et al. | |
| 6,997,657 | B1 * | 2/2006 | Saward | 410/106 |
| 7,281,889 | B2 * | 10/2007 | Anderson et al. | 410/104 |
| 7,594,787 | B2 * | 9/2009 | Womack et al. | 410/104 |
| 7,669,723 | B2 * | 3/2010 | Kao | 211/70.6 |
| 7,717,278 | B2 * | 5/2010 | Kao | 211/70.6 |
| 2002/0144962 | A1 * | 10/2002 | Dettorre et al. | 211/85.7 |
| 2004/0200791 | A1 * | 10/2004 | Bostick et al. | 211/94.01 |
| 2005/0029208 | A1 * | 2/2005 | Paiste et al. | 211/85.6 |
| 2005/0247653 | A1 * | 11/2005 | Brooks | 211/94.01 |
| 2009/0194494 | A1 * | 8/2009 | Kao | 211/70.6 |
| 2010/0096347 | A1 * | 4/2010 | Theobald et al. | 211/85.7 |

* cited by examiner

*Primary Examiner* — Jennifer E. Novosad
(74) *Attorney, Agent, or Firm* — Neustel Law Offices

(57) ABSTRACT

A skateboard deck display system for efficiently displaying one or more skateboard decks. The skateboard deck display system generally includes a support base, a plurality of support members extending from the support base and aligned with the deck holes of a skateboard deck, and a plurality of T-nuts connected to the distal portion of the support members with an elongated portion of the T-nuts extending through the deck holes of the skateboard deck.

14 Claims, 13 Drawing Sheets

SKATEBOARD DECK DISPLAY SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to skateboard deck displays and more specifically it relates to a skateboard deck display system for efficiently displaying one or more skateboard decks.

2. Description of the Related Art

Any discussion of the related art throughout the specification should in no way be considered as an admission that such related art is widely known or forms part of common general knowledge in the field.

Racks for supporting and displaying one or more skateboards for businesses have been in use for years. A common type of skateboard rack involves a plurality of extended members (e.g. hooks) that extend from a wall and engage the skateboard. One problem with conventional skateboard displays is that they can be difficult to utilize. Another problem with conventional skateboard displays is that they can be relatively unsightly particularly for a business displaying skateboard decks for sale.

Because of the inherent problems with the related art, there is a need for a new and improved skateboard deck display system for efficiently displaying one or more skateboard decks.

BRIEF SUMMARY OF THE INVENTION

The general purpose of the present invention is to provide a skateboard deck display system that has many of the advantages of the skateboard deck displays mentioned heretofore. The invention generally relates to a skateboard deck display which includes a support base, a plurality of support members extending from the support base and aligned with the deck holes of a skateboard deck, and a plurality of T-nuts connected to the distal portion of the support members with an elongated portion of the T-nuts extending through the deck holes of the skateboard deck.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a skateboard deck display system for efficiently displaying one or more skateboard decks.

Another object is to provide a skateboard deck display system that allows skateboard decks to be easily attached and removed.

A further object is to provide a skateboard deck display system that can be adjusted to prevent removal of the skateboard decks thereby preventing theft.

An additional object is to provide a skateboard deck display system that displays a plurality of skateboard decks in an aesthetically pleasing manner.

A further object is to provide a skateboard deck display system that does not interfere with the overall appearance of the skateboards.

Another object is to provide a skateboard deck display system that is capable of displaying various sizes and styles of skateboard decks.

A further object is to provide a skateboard deck display system that displays a plurality of skateboard decks without the wheels attached.

Another object is to provide a skateboard deck display system that adjustably displays a plurality of skateboard decks.

A further object is to provide a skateboard deck display system that provides the visual appearance that the skateboard decks are floating away from the wall with no support structure.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein:

FIG. 5*d* is an exploded upper perspective view of the alternative embodiment of the present invention with the T-nuts reversed.

DETAILED DESCRIPTION OF THE INVENTION

A. Overview

Figure 1A:
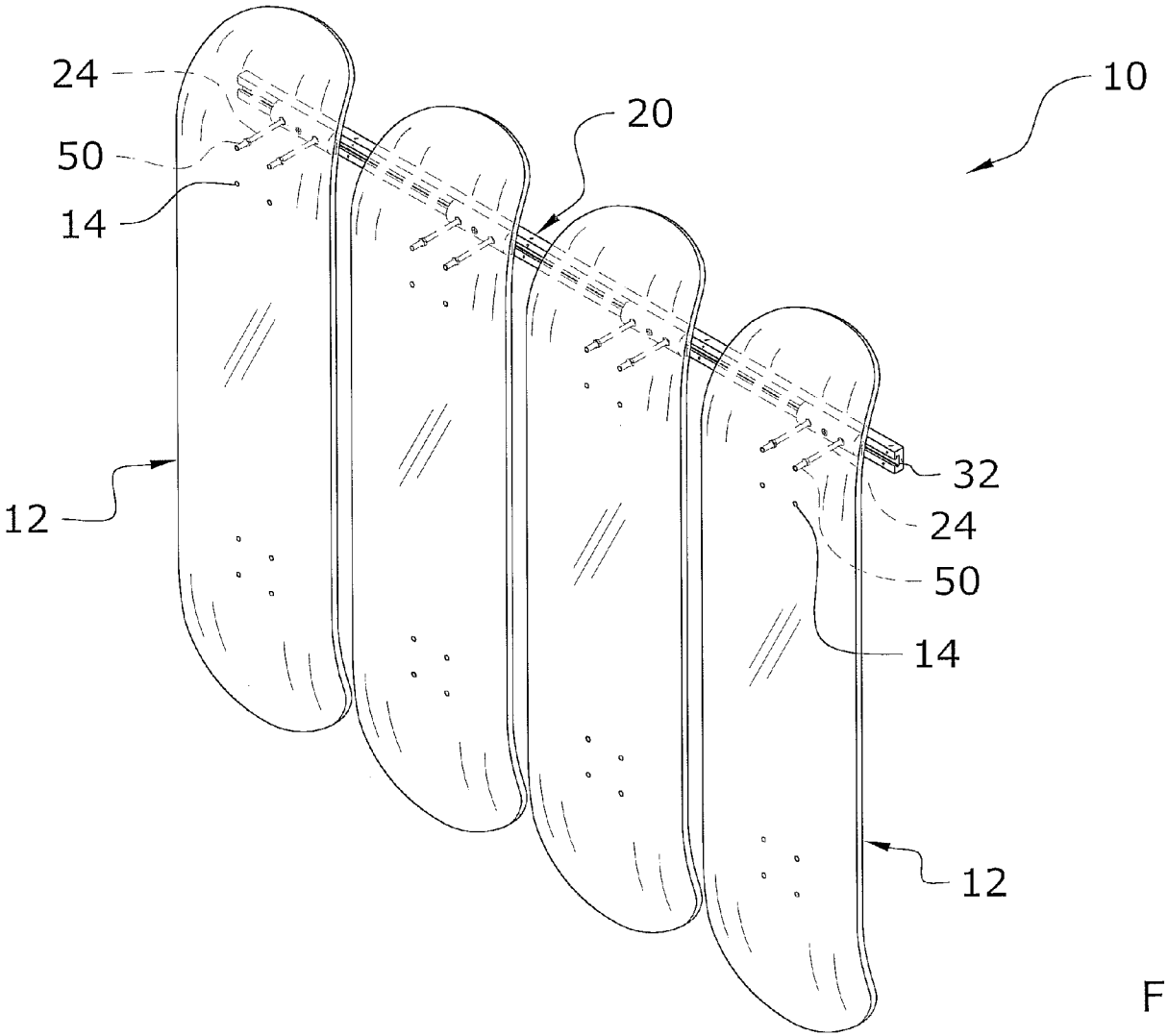
FIG. 1*a* is an upper perspective view of a preferred embodiment of the present invention.

Turning now descriptively to the drawings, in which similar reference characters denote similar elements throughout the several views, FIGS. 1 through 8 illustrate a skateboard deck display system 10, which comprises a support base 20, a plurality of support members 24 extending from the support base 20 and aligned with the deck holes 14 of a skateboard deck 12, and a plurality of T-nuts 50 connected to the distal portion of the support members 24 with an elongated portion of the T-nuts 50 extending through the deck holes 14 of the skateboard deck 12. FIGS. 1*a* through 4 illustrate a preferred embodiment utilizing an adjustable support 40 slidably connected to the support base 20 and FIGS. 5*a* through 8 illustrate an alternative embodiment wherein the support members 24 are directly connected to the support base 20.

B. Skateboard Deck

Figure 1B:
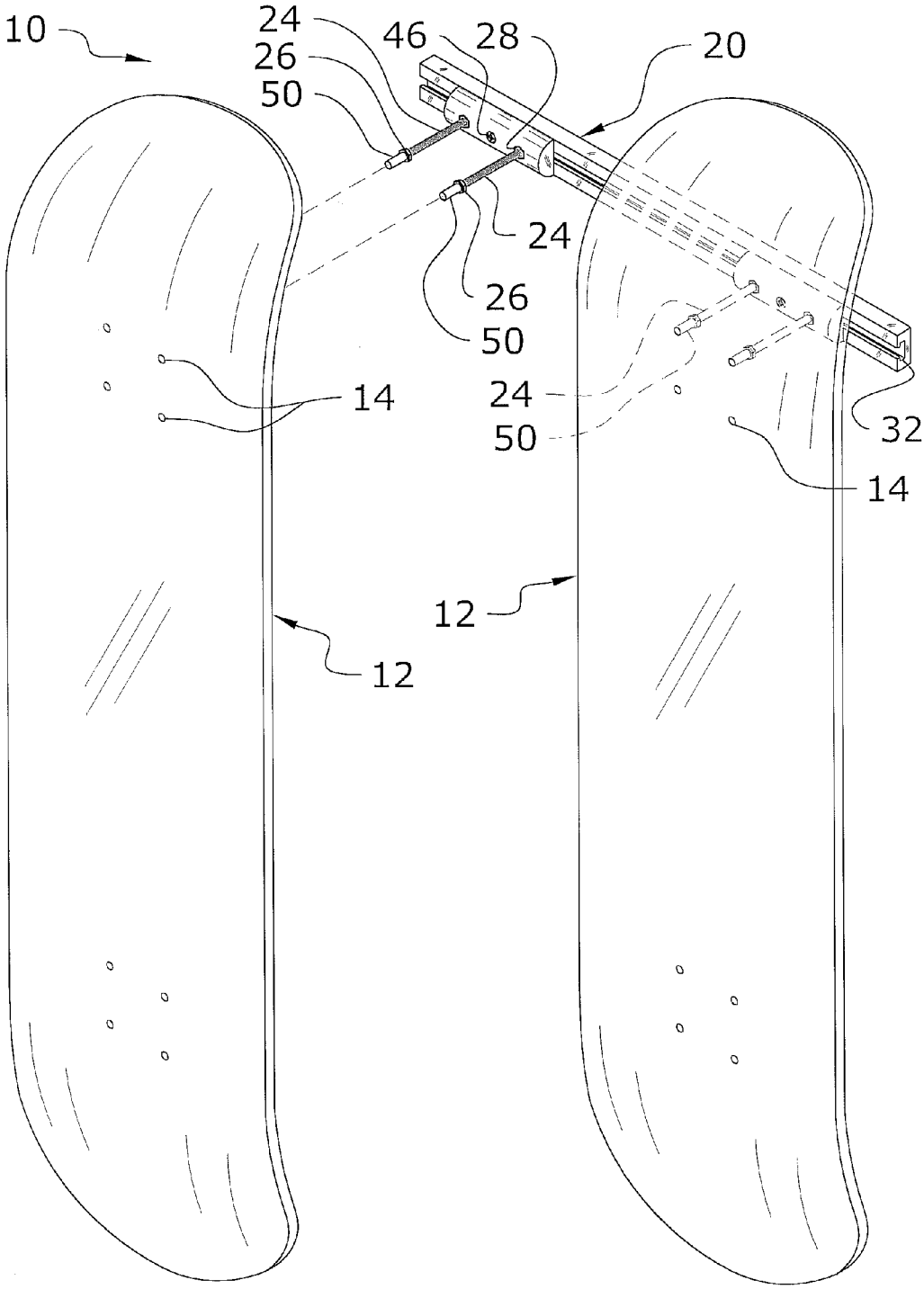
FIG. 1*b* is an exploded upper perspective view of the preferred embodiment of the present invention.
Figure 1C:
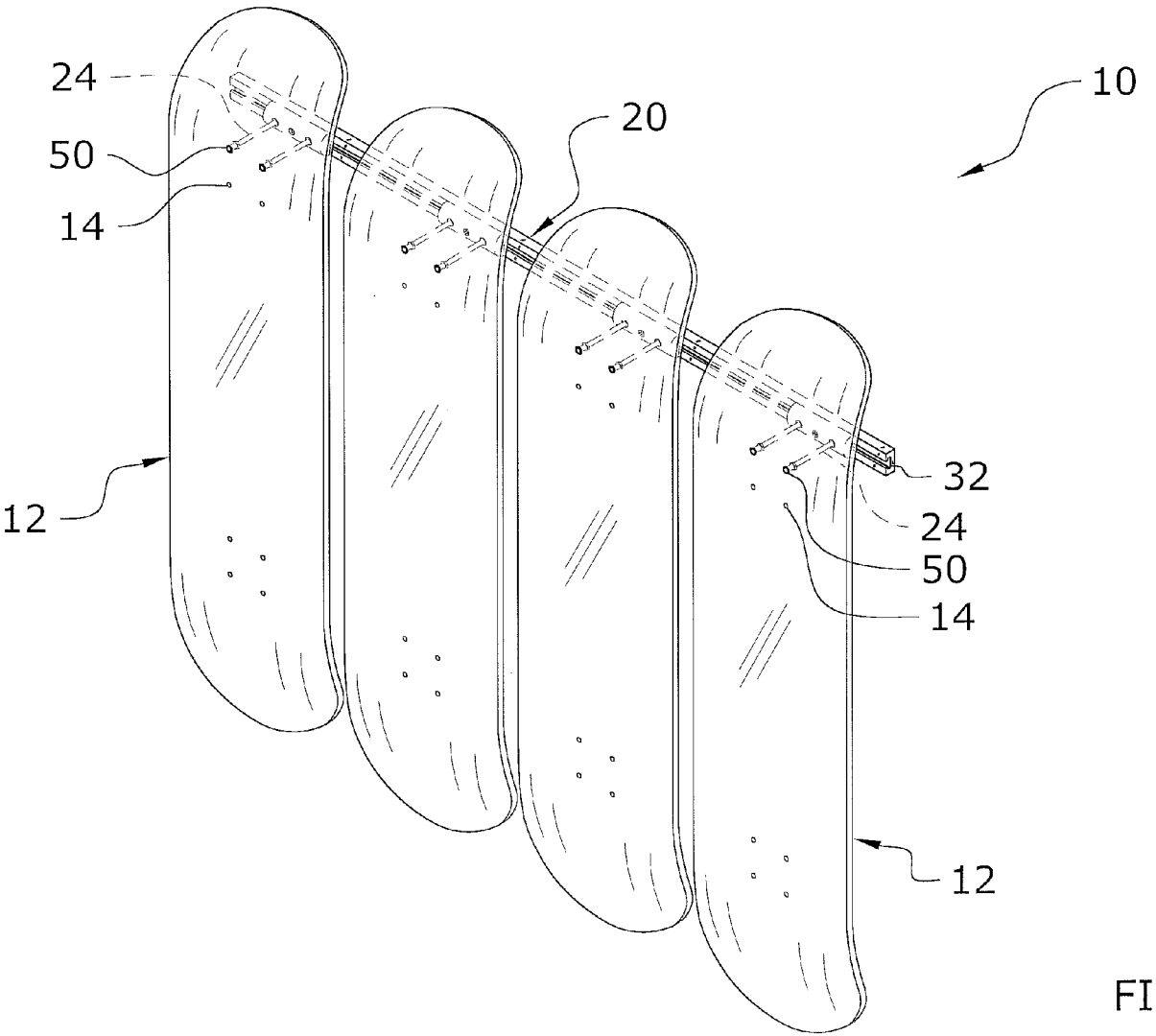
FIG. 1*c* is an upper perspective view of a preferred embodiment of the present invention with the T-nuts reversed to secure the skateboard deck.
Figure 1D:
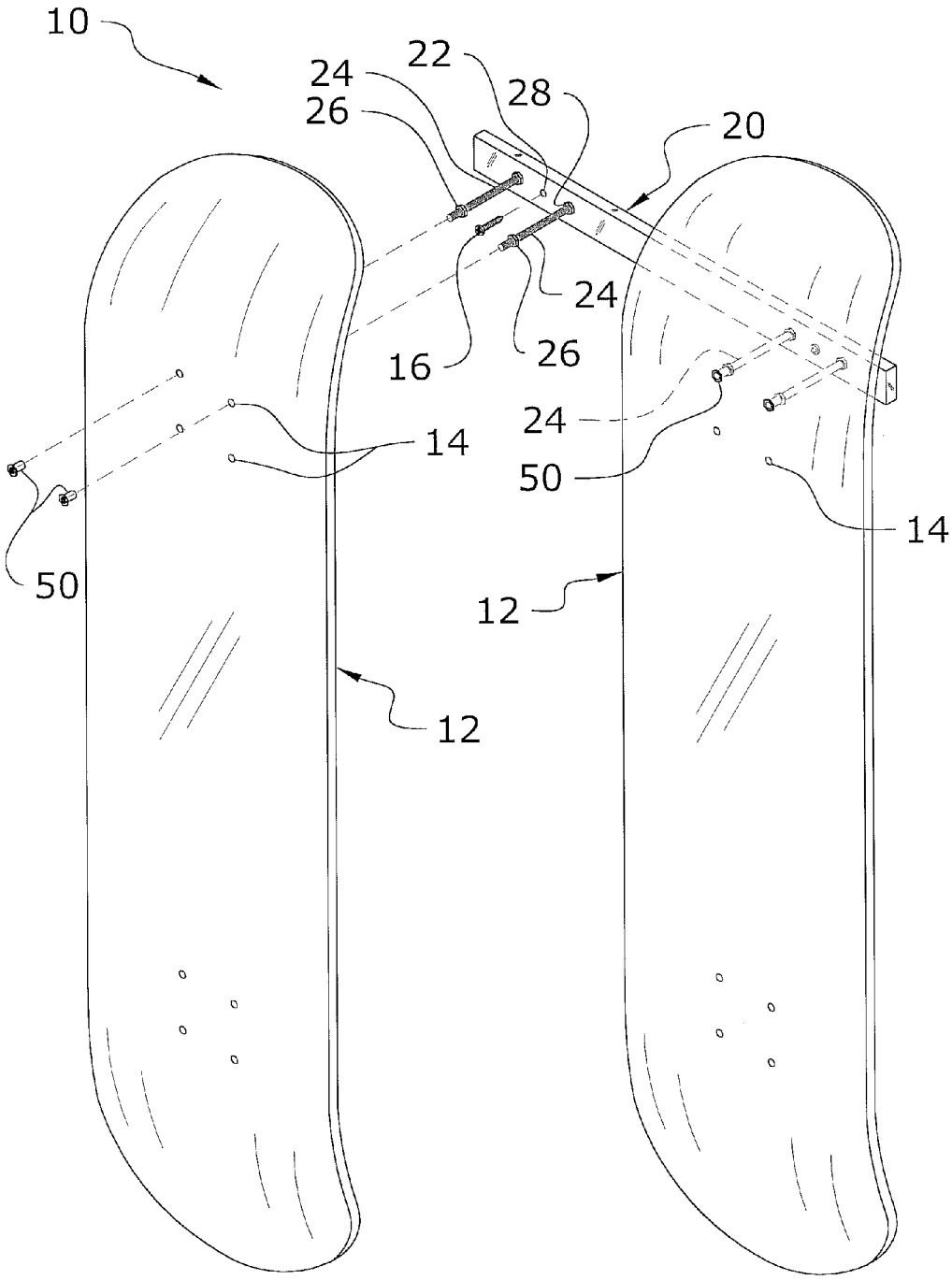
FIG. 1*d* is an exploded upper perspective view of the preferred embodiment of the present invention with the T-nuts reversed.

FIGS. 1*a* through 1*d* illustrate exemplary conventional skateboard decks 12. As illustrated in FIGS. 1*b* and 1*d* of the drawings, conventional skateboard decks 12 typically include multiple pairs of deck holes 14 for mounting the wheels to the skateboard deck 12. Conventional skateboard decks 12 may have various sizes, shapes and styles which are suitable for usage with the present invention.

C. Support Base

The support base 20 preferably is comprised of an elongated and narrow structure capable of supporting one or more skateboard decks 12. The support base 20 is preferably attached to a wall 11 in a substantially horizontal manner to maximize the number of skateboard desks to be supported and to enhance the visual effect of the boards floating as illustrated in FIGS. 1*a* through 1*d* of the drawings. One or more mounting holes 22 preferably extend through a rear portion of the support base 20 that receive a corresponding number of securing fasteners 16 that secure the support base 20 to the wall. However, the support base 20 may be attached a vertical or angled manner.

FIGS. 1*a* through 4 illustrate a preferred embodiment of the support base 20 wherein the support base 20 includes a slot that adjustably receives the support members 24. The slot is preferably comprised of a T-slot 32 having a T-shaped cross sectional area. The T-slot 32 includes a narrower portion in the front of the support base 20 with a broader portion within the inner portion of the support base 20. The T-slot 32 preferably extends along an entire length of the support base 20.

FIGS. 5*a* through 8 illustrate an alternative embodiment of the support base 20 wherein the support base 20 does not include a slot. The alternative embodiment of the support base 20 is preferably comprised of a relatively solid structure that includes a pair of receiver holes 42 that receive the pair of support members 24 similar to how the support members 24 are secured to the adjustable support 40.

D. Support Members

As shown in FIGS. 1*a* through 8 of the drawings, one or more pairs of support members 24 extend outwardly from the support base 20 to support a corresponding number of skateboard decks 12. The support members 24 are preferably threaded along a substantial length thereof to threadably receive threaded nuts and T-nuts 50 as discussed herein.

The pair of support members 24 preferably extend outwardly substantially parallel to one another and substantially hidden behind the skateboard deck 12 being supported. The pair of support members 24 are preferably substantially concentrically aligned with a pair deck holes 14 of the skateboard deck 12 as the distal portions of the pair of support members 24 extend into the deck holes 14 of the skateboard deck 12.

E. T-Nuts

As best illustrated in FIGS. 1*b*, 1*d*, 5*a* and 5*d* of the drawings, a pair of T-nuts 50 are connected to the distal portions of each pair of support members 24. The T-nuts 50 are preferably comprised of an elongated portion and a relatively flat head portion. The head portion preferably has a hexagonal or related shape to allow for grasping with tools, however the head portion of the T-nuts 50 may be comprised of a circular shape forming a T-shaped structure.

The elongated portion of the T-nuts 50 is preferably circular in shape and has an outer diameter slightly smaller than the inner diameter of the deck holes 14. The outer surface of the elongate portion of the T-nut 50 is also preferably substantially smooth to prevent damage to the skateboard deck 12 by the support members 24. The elongated portion of the pair of T-nuts 50 preferably extend through the corresponding pair of deck holes 14 of the skateboard deck 12.

FIGS. 1*a* and 1*b* illustrate a first position for the T-nuts 50 wherein the head portion is on the inside and the elongated portion extends outwardly to extend through the deck holes 14 of the skateboard deck 12. As shown in FIGS. 1*a* and 1*b* of the drawings, a user may easily attach and remove a skateboard deck 12 from the support members 24 by sliding the skateboard deck 12 on or off the T-nuts 50. The distal end of the elongated portion of the T-nuts 50 is preferably adjacent to the corresponding distal end of the support member 24 it is attached to as illustrated in FIG. 1*b* of the drawings.

A pair of adjustment members 26 are preferably threadably attached to the pair of support members 24 adjacent to the head portions of the T-nuts 50 to retain the T-nuts 50 in a locked position upon the support members 24. In particular, the adjustment members 26 are preferably comprised of a threaded nut structure that is fastened adjacent to the T-nuts 50 in a tight manner thereby preventing rotation or loosening of the T-nuts 50 from the support members 24.

FIGS. 1*c* and 1*d* illustrate a second position for the T-nuts 50 to secure a skateboard deck 12 to the support members 24 to prevent removal of the skateboard deck 12 and theft thereof. In particular, the T-nuts 50 are reversed in position so that the head portion extends outwardly and the elongated portion of the T-nuts 50 extends inwardly with the head portion retaining the skateboard deck 12 on the support members 24. The distal end of the elongated portion is tightened adjacent to the adjustment members 26 thereby preventing removal of the T-nuts 50 without the proper tools. In use, the adjustment members 26 are positioned inwardly upon the support members 24 a distance approximately equal to the thickness of the skateboard deck 12. The user then positions the skateboard deck 12 upon the exposed threaded distal portions of the support members 24 adjacent to the adjustment members 26. The user then inserts and threadably secures the T-nuts 50 upon the support members 24 extending the elongated portion through deck holes 14. Utilizing conventional tools, the adjustment member 26 is tightened against the distal end of the elongated portion of the T-nuts 50.

F. Adjustable Support (Preferred Embodiment)

Figure 2:
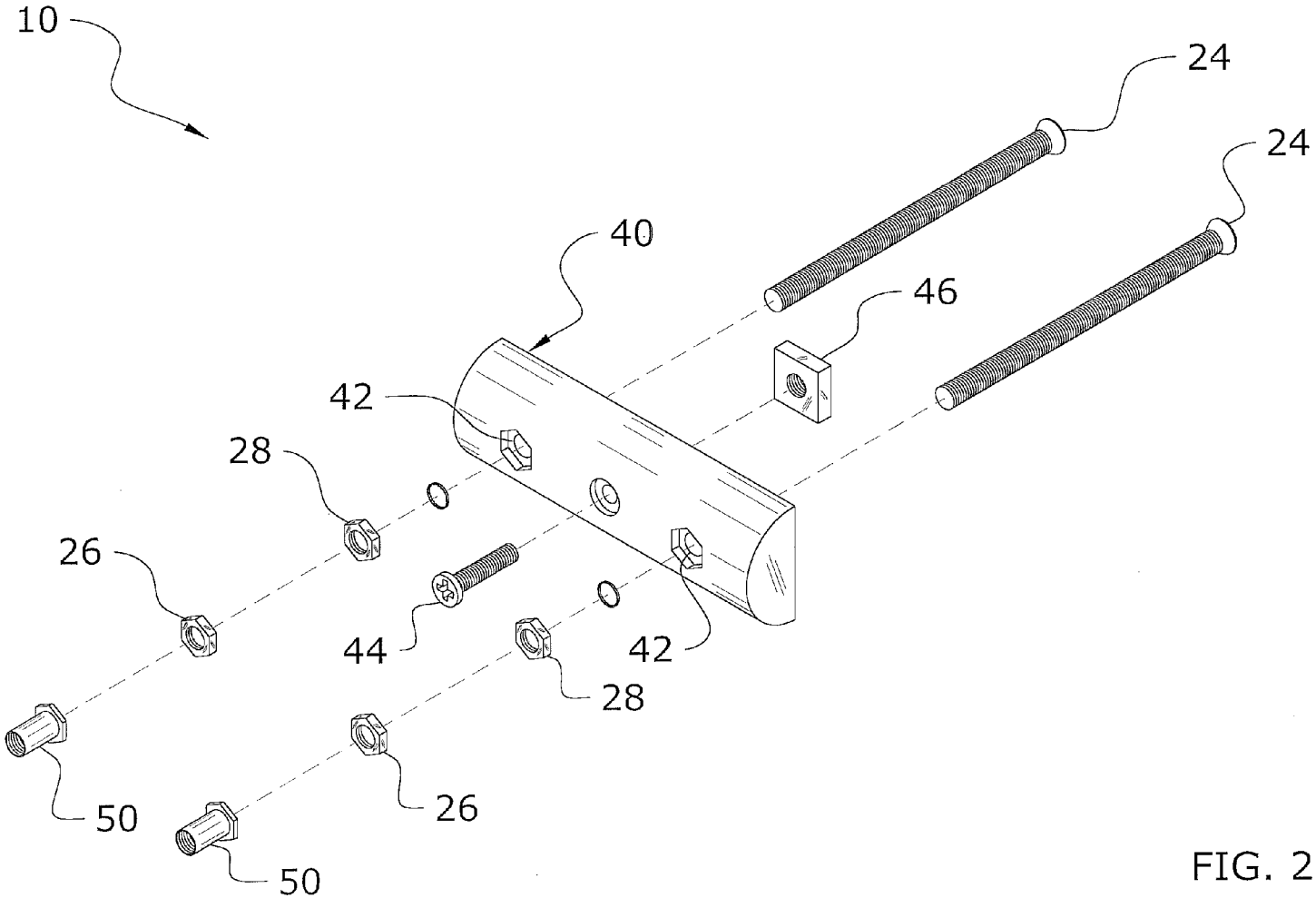
FIG. 2 is an exploded upper perspective view of the adjustable support and fasteners.
Figure 3:
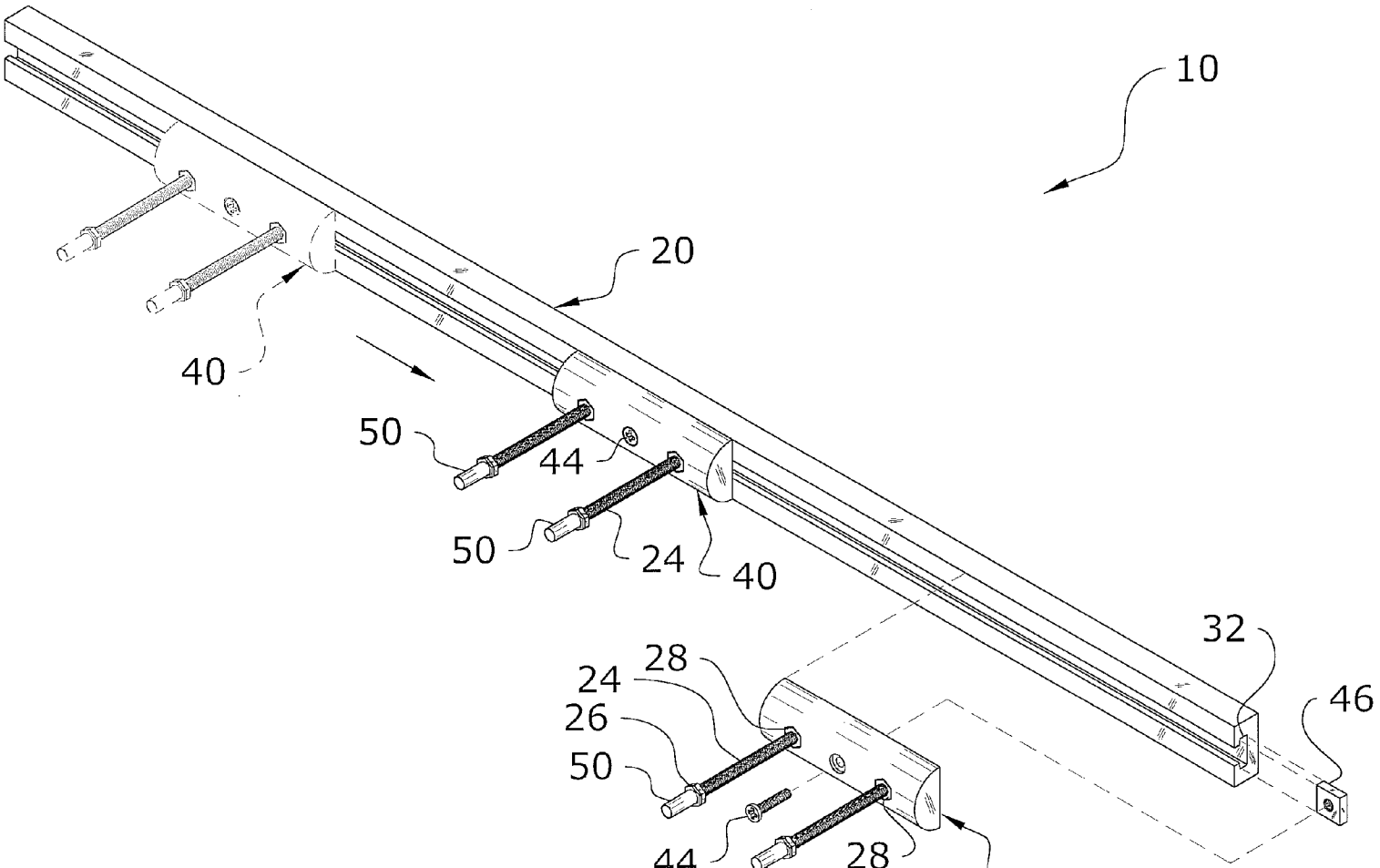
FIG. 3 is an exploded upper perspective view of the preferred embodiment of the present invention.
Figure 4:
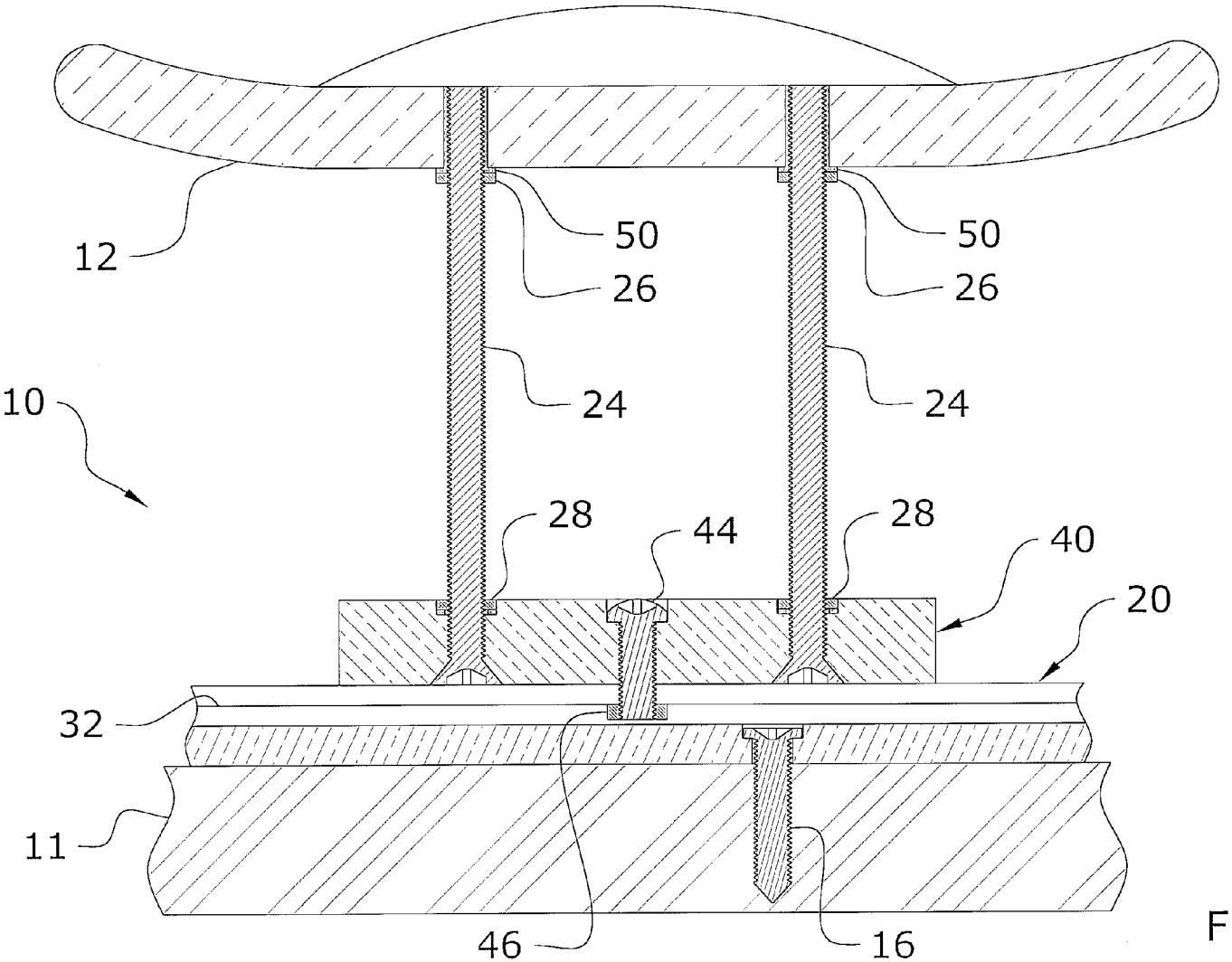
FIG. 4 is a cutaway view of the preferred embodiment supporting a skateboard deck.
Figure 5A:
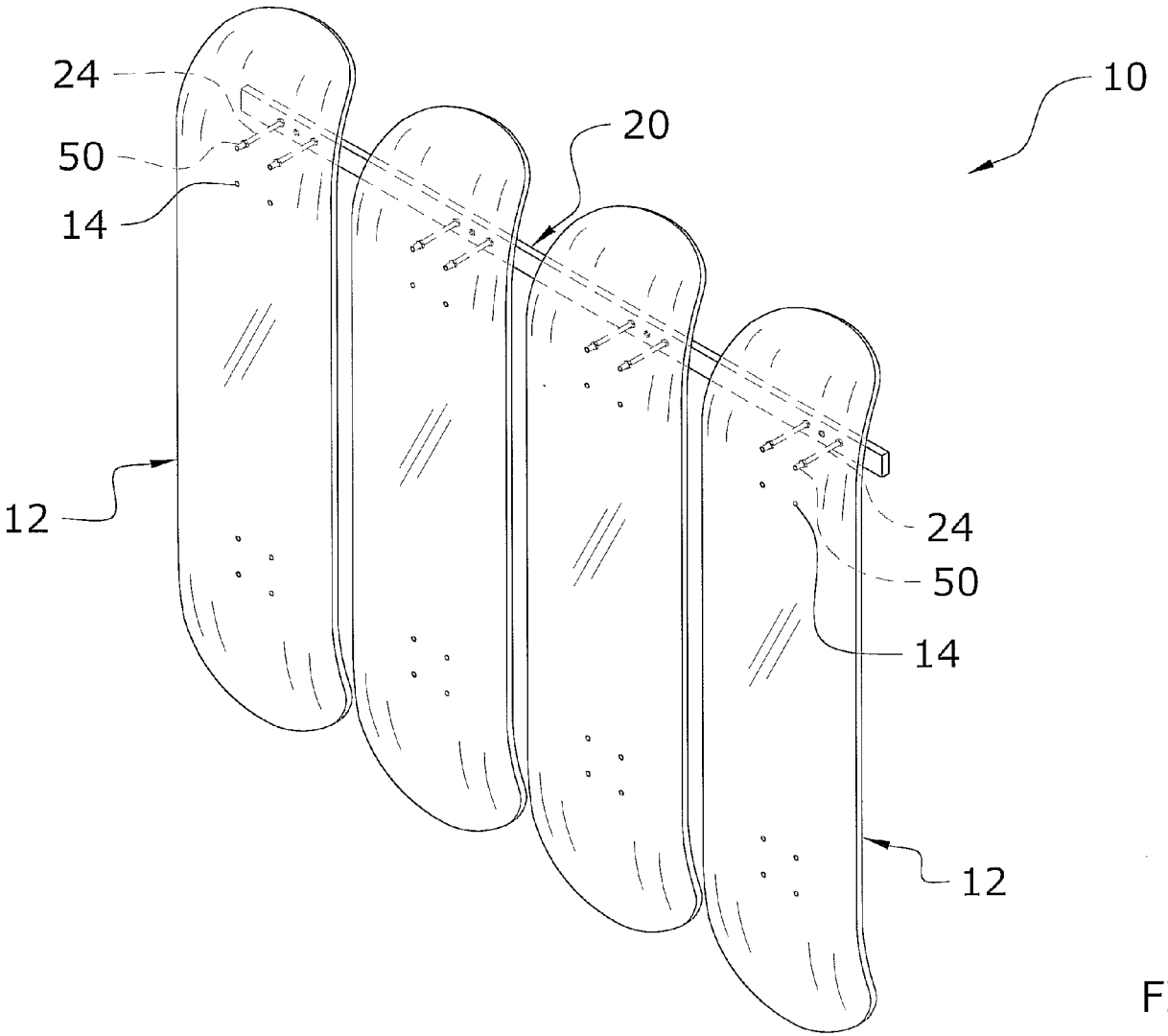
FIG. 5*a* is an upper perspective view of an alternative embodiment of the present invention.
Figure 5B:
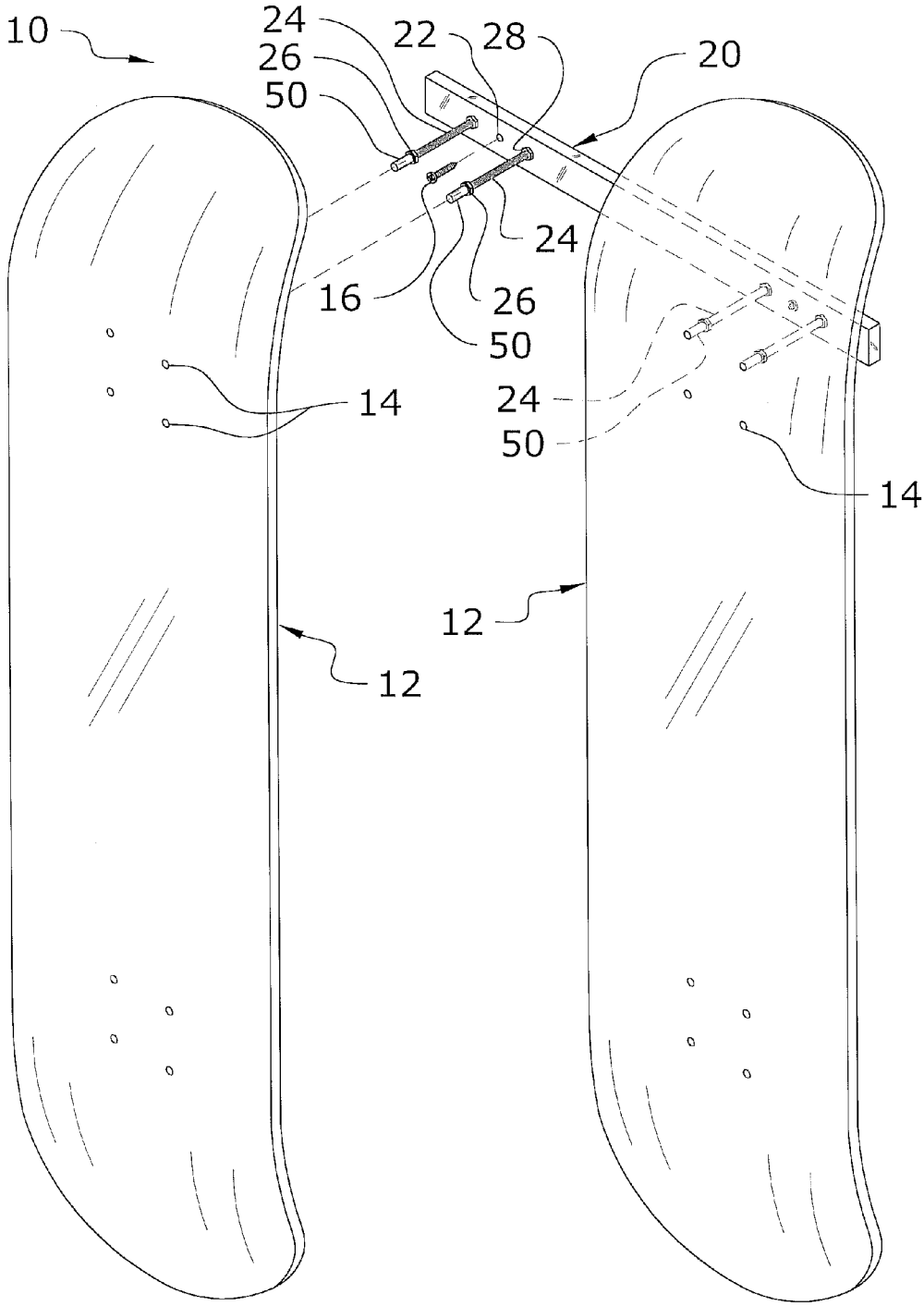
FIG. 5*b* is an exploded upper perspective view of the alternative embodiment of the present invention.
Figure 5C:
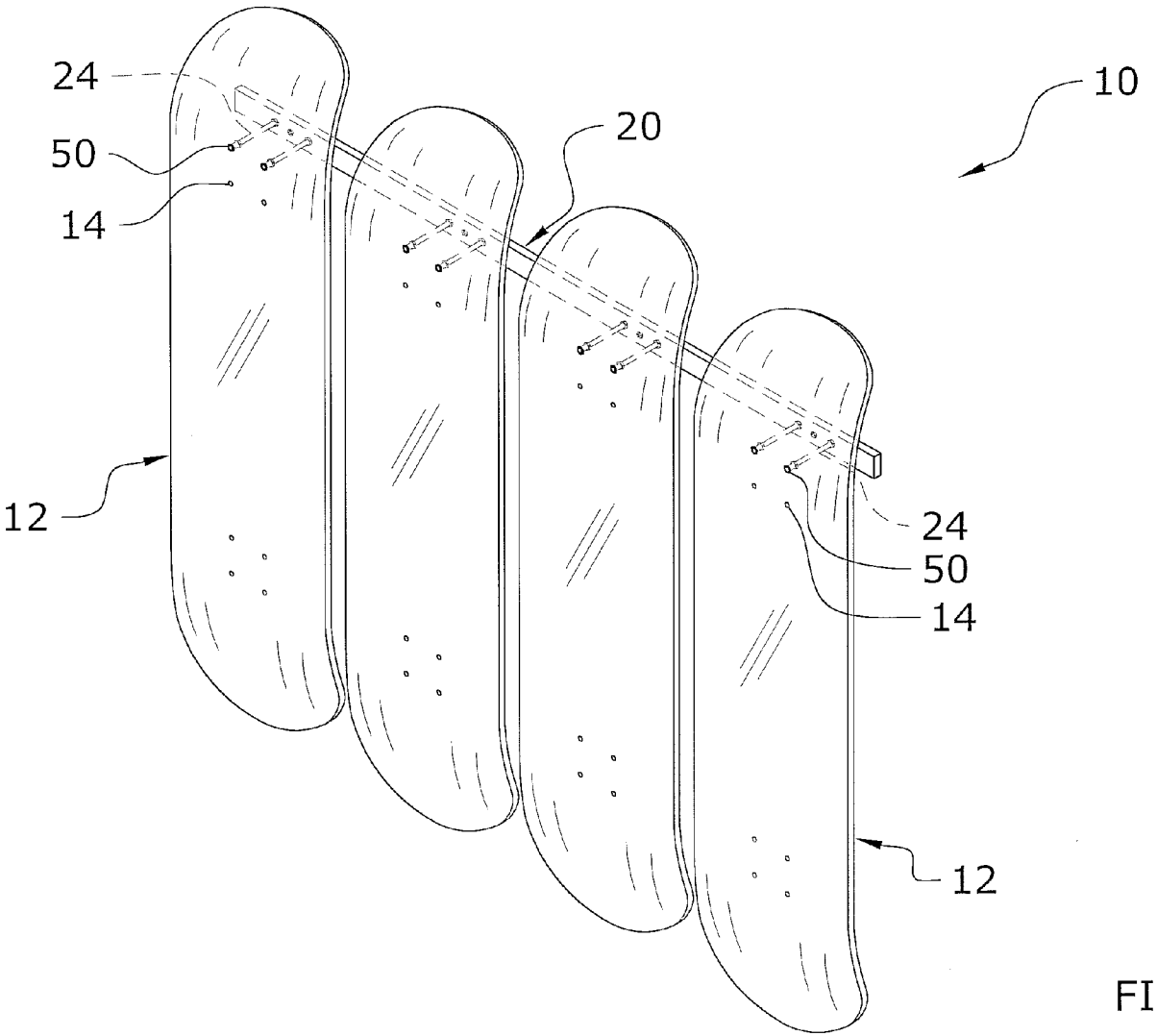
FIG. 5*c* is an upper perspective view of an alternative embodiment of the present invention with the T-nuts reversed to secure the skateboard deck.
Figure 6:
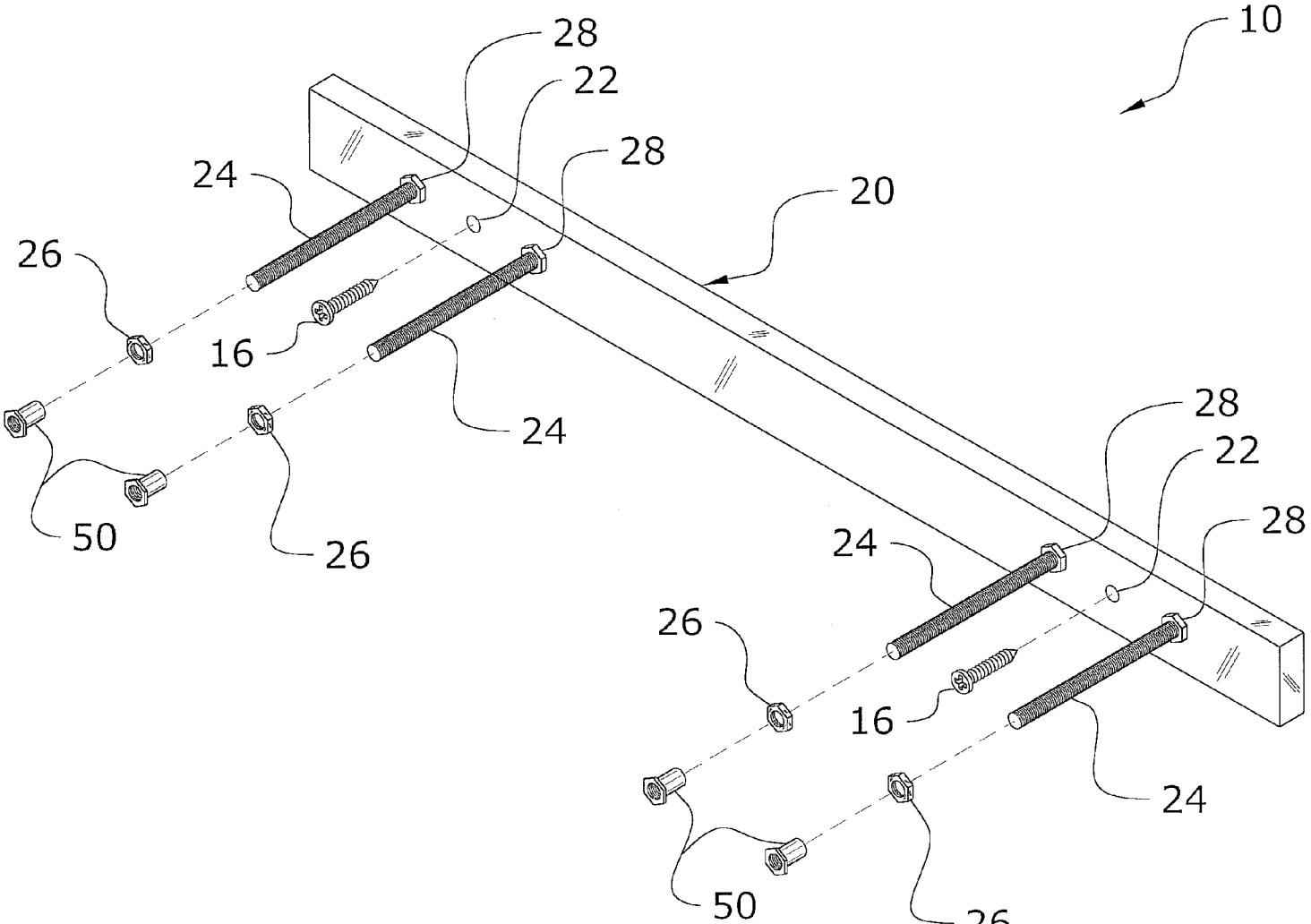
FIG. 6 is an exploded upper perspective view of the support base for the alternative embodiment.
Figure 7:
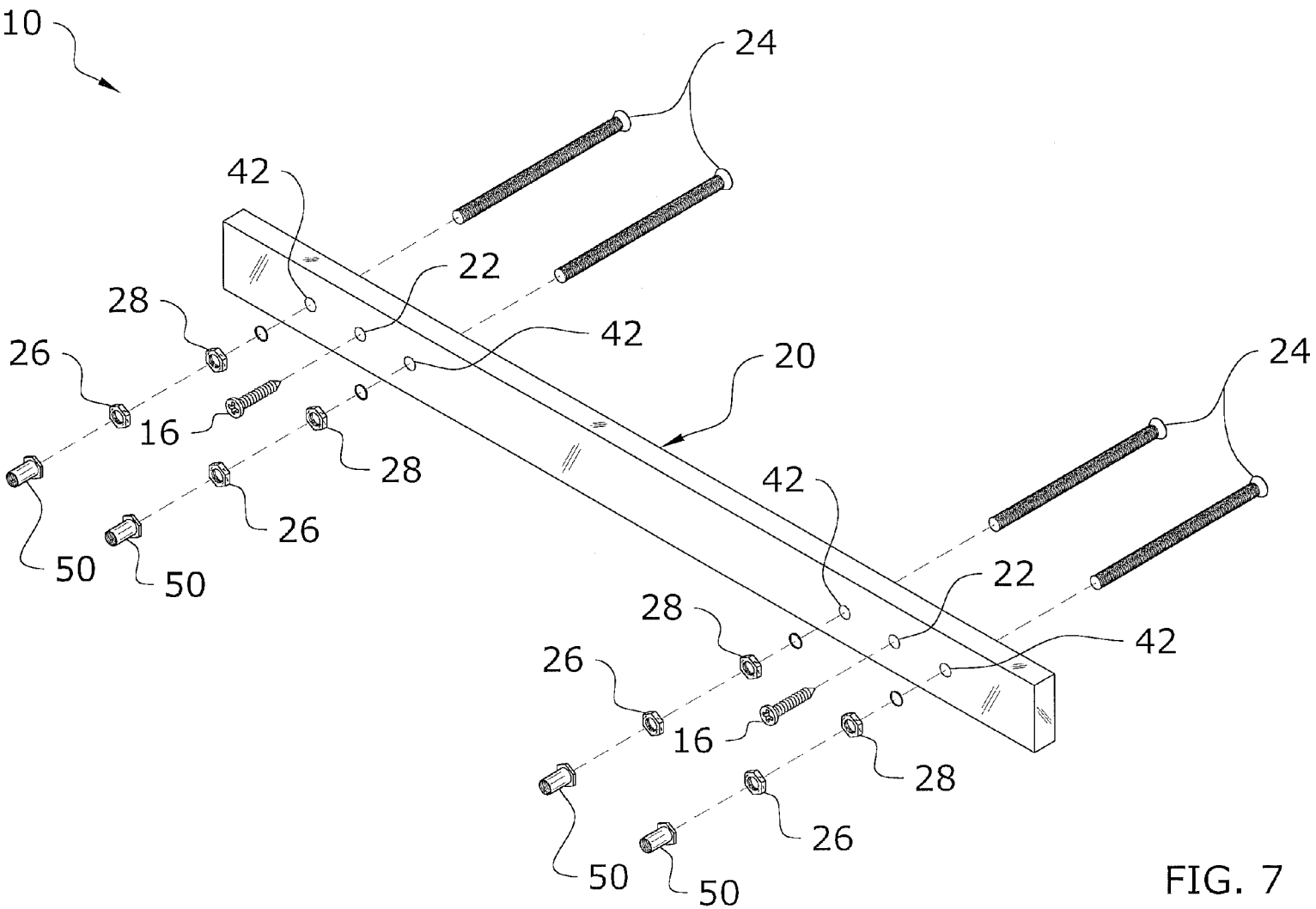
FIG. 7 is an exploded upper perspective view of the support base and fasteners for the alternative embodiment.
Figure 8:
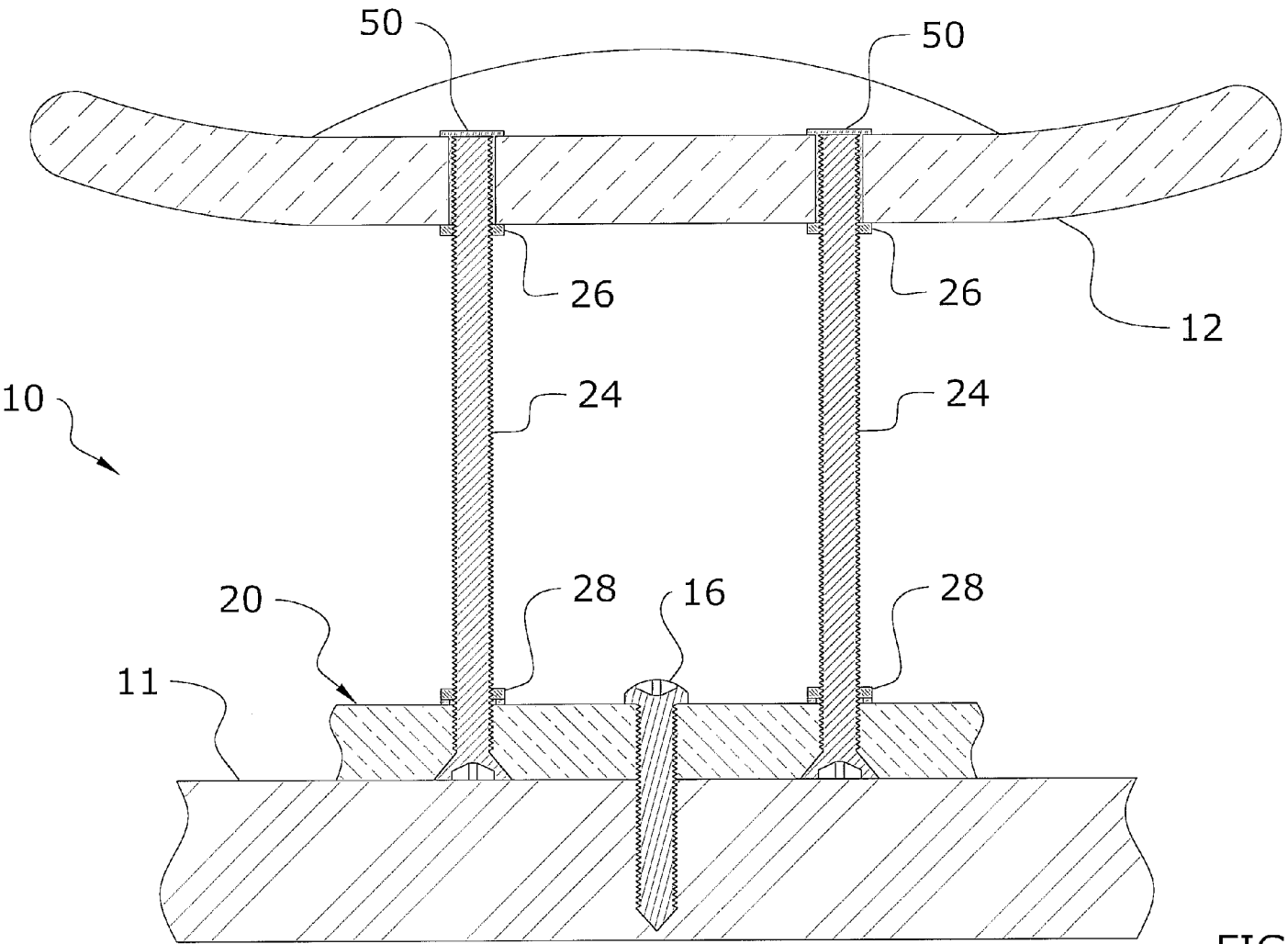
FIG. 8 is a cutaway view of the alternative embodiment supporting a skateboard deck.

As best illustrated in FIGS. 3 and 4 of the drawings, the adjustable support 40 is slidably connected to the T-slot 32 within the support base 20. The pair of support members 24 extend from the adjustable support 40 as shown in FIGS. 1*a* through 4 of the drawings. An adjustment fastener 44 preferably extends through the adjustable support 40 into the T-slot 32 and an adjustment nut 46 is secured to the adjustment fastener 44. The adjustment nut 46 is preferably slidably retained within the T-slot 32 and has a size similar to the broad portion of the T-slot 32. The adjustment nut 46 also preferably has an outer perimeter that is slightly smaller than the height of the broad portion of the T-slot 32 thereby preventing rotation of the adjustment nut 46 when the adjustment fastener 44 is secured through the adjustable support 40.

The adjustable support 40 preferably includes a pair of receiver holes 42 that receive the pair of support members 24 as best illustrated in FIG. 2 of the drawings. A pair of locking nuts 28 are preferably attached to the pair of support members 24 on an opposite side of the heads of the pair of support members 24 to secure the pair of support members 24 to the adjustable support 40 as shown in FIGS. 2 and 4 of the drawings. The locking nuts 28 are tightened adjacent the adjustable support 40 to securely retain the support members 24 within the adjustable support 40 in a non-movable manner. Various types of washers may be utilized in combination with the fasteners. For the alternative embodiment of the present invention, the receiver holes 42 extend through the support base 20 directly and receive the support members 24 as shown in FIGS. 5*a* through 8 of the drawings.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A skateboard deck display system, comprising:

a support base;

a pair of support members extending from said support base and adapted to be substantially concentrically aligned with a pair deck holes of a skateboard deck;

a pair of T-nuts connected to the distal portion of said pair of support members, wherein an elongated portion of said pair of T-nuts is adapted to extend through said pair of deck holes of said skateboard deck;

wherein said support base includes a T-slot and an adjustable support slidably connected to said T-slot, wherein said pair of support members extend from said adjustable support;

wherein said adjustable support includes a pair of receiver holes that receive said pair of support members; and a pair of locking nuts attached to said pair of support members on an opposite side of the heads of said pair of support members to secure said pair of support members to said adjustable support.

2. The skateboard deck display system of claim 1, wherein said support base has an elongated structure.

3. The skateboard deck display system of claim 2, wherein said support base is adapted to be attached to a wall in a substantially horizontal manner.

4. The skateboard deck display system of claim 1, including an adjustment fastener extending through said adjustable support into said T-slot and an adjustment nut secured to said adjustment fastener, wherein said adjustment nut is slidably retained within said T-slot.

5. The skateboard deck display system of claim 4, wherein said support base has an elongated structure.

6. The skateboard deck display system of claim 5, wherein said support base is attached to a wall in a substantially horizontal manner.

7. The skateboard deck display system of claim 1, wherein said support base includes a pair of receiver holes that receive said pair of support members.

8. A skateboard deck display system, comprising:

a skateboard deck having a pair of deck holes;

a support base;

a pair of support members extending from said support base and substantially concentrically aligned with said pair deck holes of said skateboard deck;

a pair of T-nuts connected to the distal portion of said pair of support members, wherein an elongated portion of said pair of T-nuts extend through said pair of deck holes of said skateboard deck;

wherein said support base includes a T-slot and an adjustable support slidably connected to said T-slot, wherein said pair of support members extend from said adjustable support; and an adjustment fastener extending through said adjustable support into said T-slot and an adjustment nut secured to said adjustment fastener, wherein said adjustment nut is slidably retained within said T-slot;

wherein said support base has an elongated structure and wherein said support base is attached to a wall in a substantially horizontal manner.

9. The skateboard deck display system of claim 8, wherein said support base has an elongated structure.

10. The skateboard deck display system of claim 9, wherein said support base is adapted to be attached to a wall in a substantially horizontal manner.

11. The skateboard deck display system of claim 8, wherein said adjustable support includes a pair of receiver holes that receive said pair of support members.

12. The skateboard deck display system of claim 8, including a pair of locking nuts attached to said pair of support members on an opposite side of the heads of said pair of support members to secure said pair of support members to said adjustable support.

13. The skateboard deck display system of claim 8, wherein said support base includes a pair of receiver holes that receive said pair of support members.

14. A skateboard deck display system, comprising:

a skateboard deck having a pair of deck holes;

a support base, wherein said support base has an elongated structure;

wherein said support base is adapted to be attached to a wall in a substantially horizontal manner;

a pair of support members extending from said support base and substantially concentrically aligned with said pair deck holes of said skateboard deck;

a pair of T-nuts connected to the distal portion of said pair of support members, wherein an elongated portion of said pair of T-nuts extend through said pair of deck holes of said skateboard deck;

wherein said support base includes a T-slot;

an adjustable support slidably connected to said T-slot, wherein said pair of support members extend from said adjustable support;

an adjustment fastener extending through said adjustable support into said T-slot and an adjustment nut secured to said adjustment fastener, wherein said adjustment nut is slidably retained within said T-slot;

wherein said adjustable support includes a pair of receiver holes that receive said pair of support members; and a pair of locking nuts attached to said pair of support members on an opposite side of the heads of said pair of support members to secure said pair of support members to said adjustable support.

* * * * *